US007753239B2

(12) United States Patent
Chang

(10) Patent No.: US 7,753,239 B2
(45) Date of Patent: Jul. 13, 2010

(54) PRESSURIZED WATER CONTAINER WITH WATER CHAMBER REPLACEMENT ARRANGEMENT

(76) Inventor: Hsu-pin Chang, 148, Song 9th Street, Daan, Taichung (TW)

( * ) Notice: Subject to any disclaimer, the term of this patent is extended or adjusted under 35 U.S.C. 154(b) by 543 days.

(21) Appl. No.: 11/736,014

(22) Filed: Apr. 17, 2007

(65) Prior Publication Data

US 2008/0257916 A1 Oct. 23, 2008

(51) Int. Cl.
*B65D 83/00* (2006.01)

(52) U.S. Cl. ..... 222/394; 222/95; 222/399; 222/389; 222/94; 222/105

(58) Field of Classification Search ..... 222/394, 222/61, 635, 95, 105, 386.5, 399, 92, 94, 222/96, 386, 389; 215/276, 340, 352, 354; 138/30; 239/323
See application file for complete search history.

(56) References Cited

U.S. PATENT DOCUMENTS 2,144,287 A * 1/1939 Enkur ..... 215/276
2,513,455 A * 7/1950 Cornelius ..... 222/386.5
6,131,776 A * 10/2000 De Laforcade et al. ..... 222/387

* cited by examiner

*Primary Examiner*—Jerry Lorengo
*Assistant Examiner*—Heng M Chan

(57) ABSTRACT

A pressurized water container for use with a drinking water purification system includes a housing having a top opening and lower first and second valves; a sealing assembly releasably mounted on the opening of the housing; a flexible upper water chamber including a top opening in communication with the opening of the housing; a lower pressure chamber having a rigid top surface fixedly secured to an inner surface of the housing wherein pressurized air is adapted to feed into the pressure chamber through the second valve for storage; an air chamber between the water chamber and the pressure chamber; and a tube interconnecting the first valve and a bottom surface of the air chamber, the tube having a port in communication with the pressure chamber, and a hand wheel for either opening or closing the port. Replacement of the water chamber is made easy by detaching the sealing assembly.

1 Claim, 7 Drawing Sheets

PRESSURIZED WATER CONTAINER WITH WATER CHAMBER REPLACEMENT ARRANGEMENT

BACKGROUND OF THE INVENTION

1. Field of Invention

The invention relates to water containers and more particularly to a pressurized water container having an arrangement for facilitating water chamber replacement and other improved characteristics.

2. Description of Related Art

Conventionally, a pressurized water container is used to store clean water purified by a drinking water purification system. Such a conventional pressurized water container 10 is shown in FIGS. 1 and 2. The container 10 comprises a lower, expansible air chamber 11, an upper water chamber 12 formed of a flexible member (e.g., rubber) contained with water 22, a lower air valve 13 being in communication with the air chamber 11 and the external, and a projecting top opening 14 having internal threads. A cap having an externally threaded shank (not shown) is adapted to close the opening 14 by threading.

As shown in FIG. 1, high pressure air 21 is fed into the air chamber 11 through the air valve 13. The air chamber 11 thus expands to compress a flexible lower surface of the water chamber 12 (i.e., an upper surface of the air chamber 11) to reduce the size of the water chamber 12. As a result, water 22 in the water chamber 12 is discharged through the opening 14 for drinking purposes.

To the contrary, as shown in FIG. 2, clean water is fed into the water chamber 12 through the opening 14 after closing the air valve 13. The lower surface of the water chamber 12 thus lowers due to the weight of water 22 contained therein. As a result, air in the air chamber 11 is compressed.

When in use, opening the opening 14 will cause pressurized air 21 in the air chamber 11 to push the lower surface of the water chamber 12 upward to discharge water 22 through the opening 14.

The effectiveness of dispensing water 22 of the container 10 depends on air-tightness of the air chamber 11. However, such configured air chamber 11 can hinder a simple cleaning or part replacement thereof. Thus, it is typical of throwing the whole container 10 away once the container 10 is malfunctioned or too dirty to be used. Thus, the need for improvement still exists.

SUMMARY OF THE INVENTION

It is therefore one object of the invention to provide a pressurized water container for use with a drinking water purification system, the pressurized water container comprising a sealing assembly releasably mounted on its top opening so as to facilitate its water chamber replacement.

The above and other objects, features and advantages of the invention will become apparent from the following detailed description taken with the accompanying drawings.

DETAILED DESCRIPTION OF THE INVENTION

Figure 1:
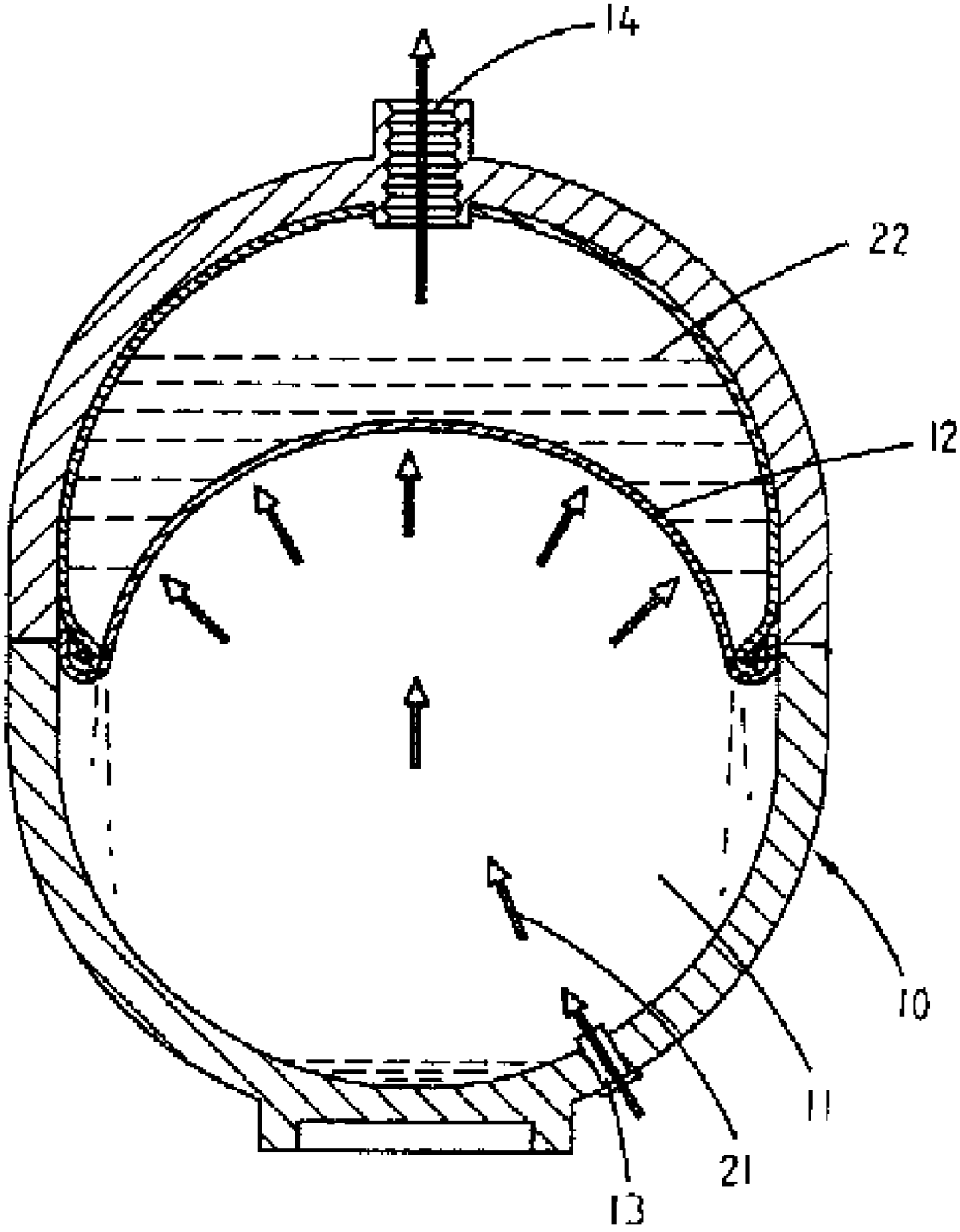
PRIOR ART FIG. 1
FIG. 1 is a longitudinal sectional view of a conventional pressurized water container where air is feeding into an air chamber for expansion in a water dispensing operation.
Figure 2:
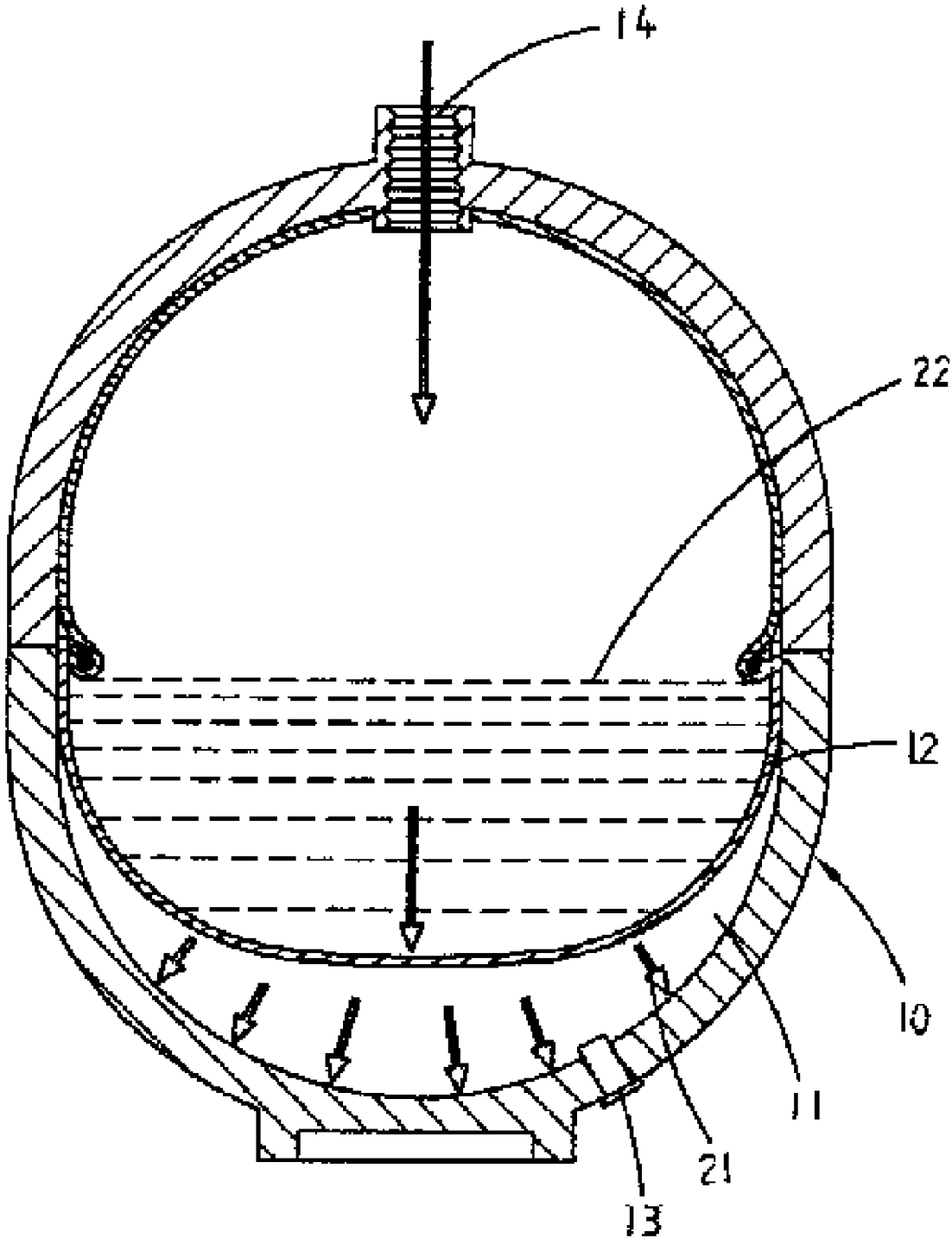
PRIOR ART FIG. 2
FIG. 2 is a view similar to FIG. 1 where water is feeding into a water chamber for compressing the air chamber in a water storing operation.

Referring to FIGS. 3 to 7, a pressurized water container 30 in accordance with a preferred embodiment of the invention is shown. The substantially cylindrical container 30 comprises an upper water chamber 40 formed of a flexible member (e.g., rubber), the water chamber 40 having a top opening 41, an intermediate air chamber 32, a lower pressure chamber 33, a circular, concave member 31 fixedly secured to an inner surface of the container 30 for separating the air chamber 32 from the pressure chamber 33, a first valve 35 on a peripheral edge of the pressure chamber 33, a tube 34 interconnecting the valve 35 and an opening (not numbered) on the concave member 31, a top opening 36 secured around the opening 41, and a second valve 37 on the surface of the container 30 for filling air into the pressure chamber 33.

The first valve 35 comprises an internal port 351 being in communication with both the pressure chamber 33 and the tube 34, and a hand wheel 350 disposed externally of the container body. Hence, a person may turn the hand wheel 350 to, for example, open the port 351 to allow pressurized air in the pressure chamber 33 to flow into the air chamber 32 through the port 351 and the tube 34. To the contrary, a person may turn the hand wheel 350 in an opposite direction to, for example, close the port 351 to stop feeding air into the air chamber 32 from the pressure chamber 33.

A rim 360 is formed at the opening 36. A flexible sealing ring 410 is formed at the opening 41 with the rim 360 sealingly secured therearound. A hole 70 is formed through a recessed center of a disc shaped cap 60. A cap member (not shown) is adapted to secure to the hole 70. The cap 60 has a rigid sealing member 61 formed around a bottom of its recessed center. A washer 50 is put on the bottom of the recessed center of the cap 60. A plurality of fasteners (e.g., screws) are driven through the cap 60 and the washer 50 into the rim 360 to mount both the cap 60 and the washer 50 on the opening 36. Further, the sealing member 61 presses the sealing ring 410 to flexibly deform same to form a sealing section 62 which is adapted to prevent water stored in the water chamber 40 from leaking through the opening 41.

The container 30 comprises an upper half housing 300 and a lower half housing 301. The concave member 31 has a skirt 310 extending downward from an edge of the concave member 31. The skirt 310 is fixedly secured to an inner surface of the container 30 at a joining portion of the upper and lower half housings 300 and 301 by soldering.

Figure 3:
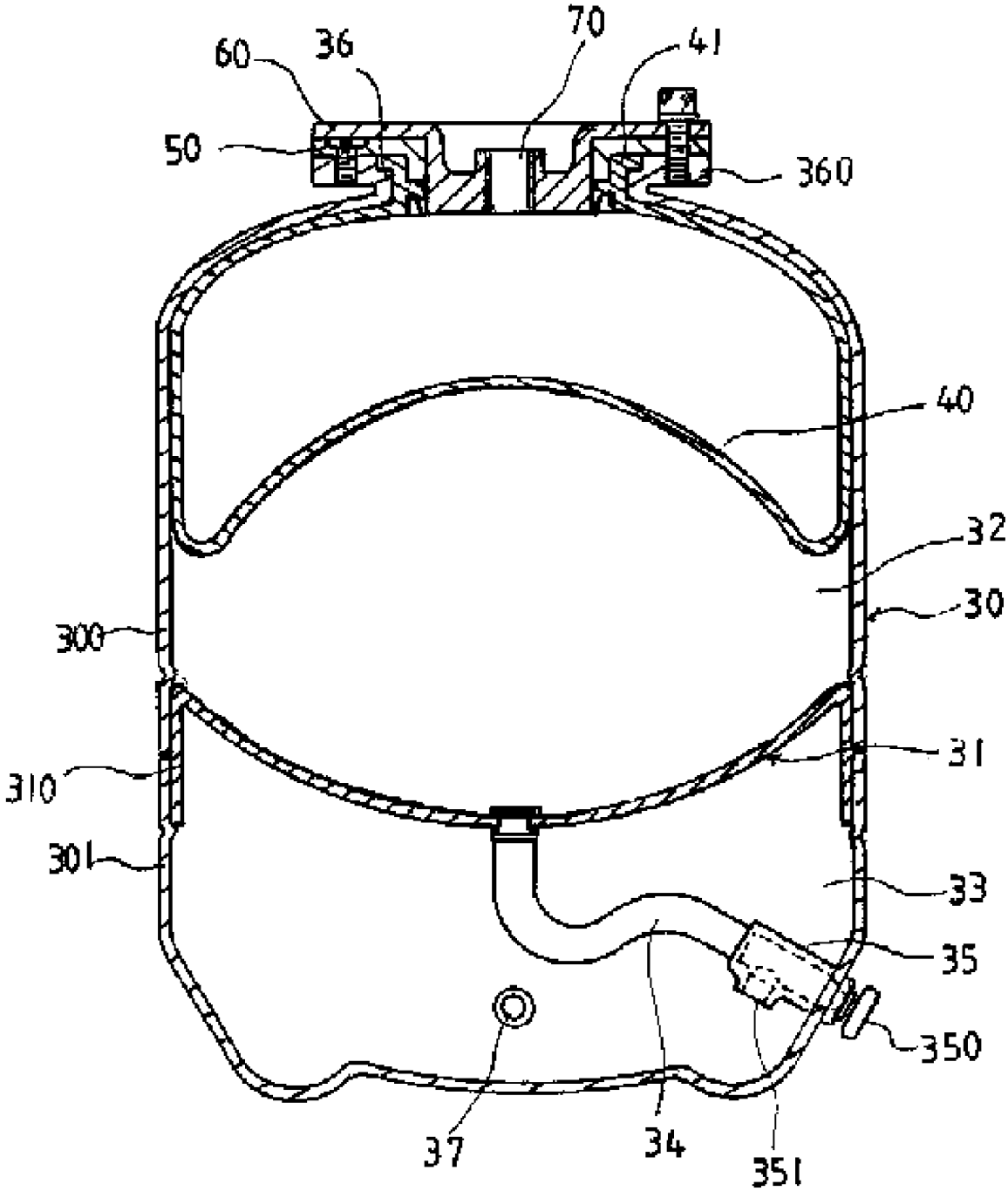
FIG. 3 is a longitudinal sectional view of a preferred embodiment of pressurized water container according to the invention where an air chamber is inflated.

As shown in FIG. 3, it is assumed that the pressure chamber 33 is full of high pressure air. Next, the high pressure air is fed into the air chamber 32 through the tube 34 by opening the port 351 by turning the hand wheel 350 in one direction. The air chamber 32 thus expands to compress a flexible lower surface of the water chamber 40 (i.e., an upper surface of the air chamber 32) to reduce the size of the water chamber 40. As a result, water in the water chamber 40 is discharged through the hole 70 for drinking purposes.

Figure 4:
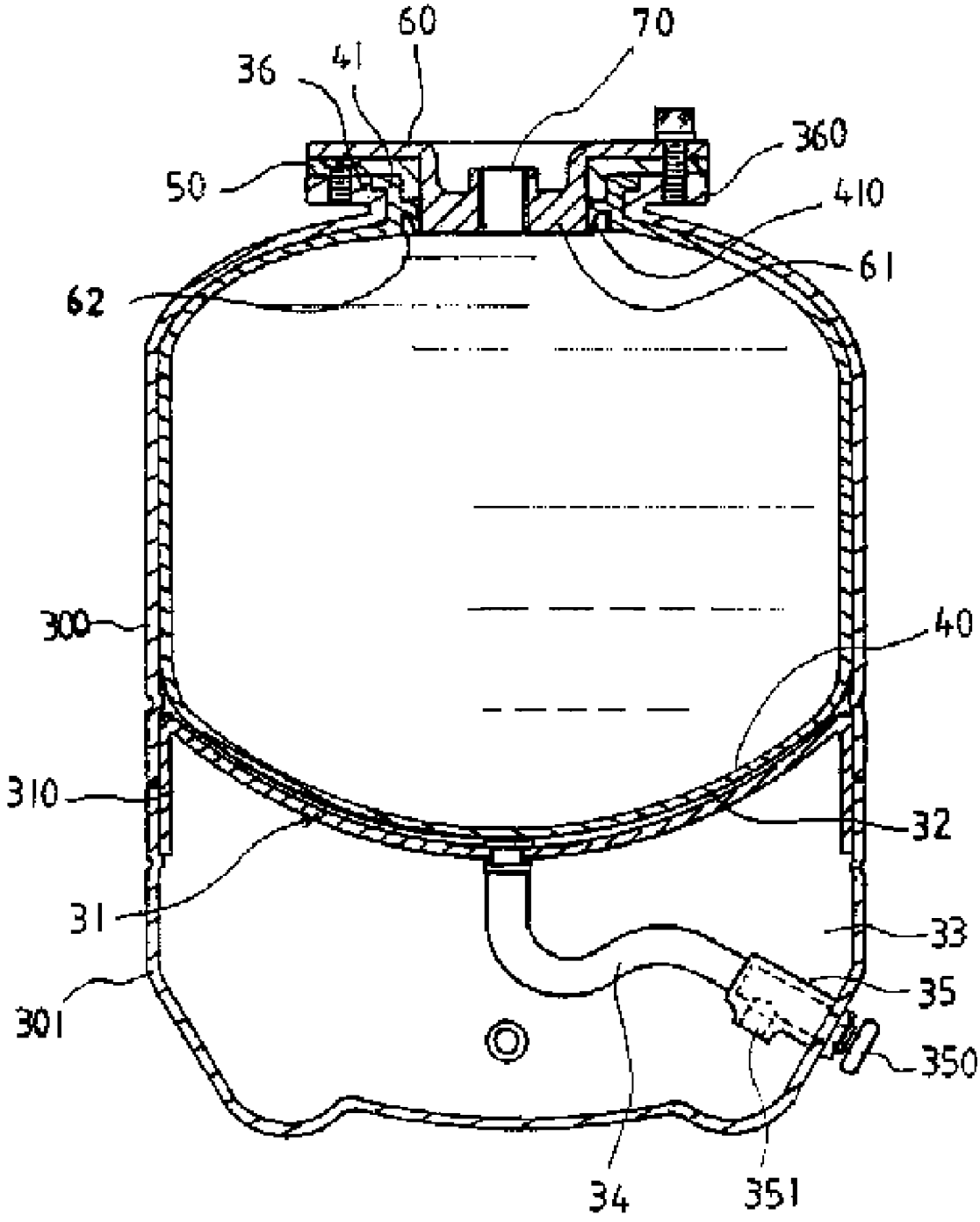
FIG. 4 is a view similar to FIG. 3 where a water chamber is full of water with the air chamber compressed to a minimum size.
Figure 5:
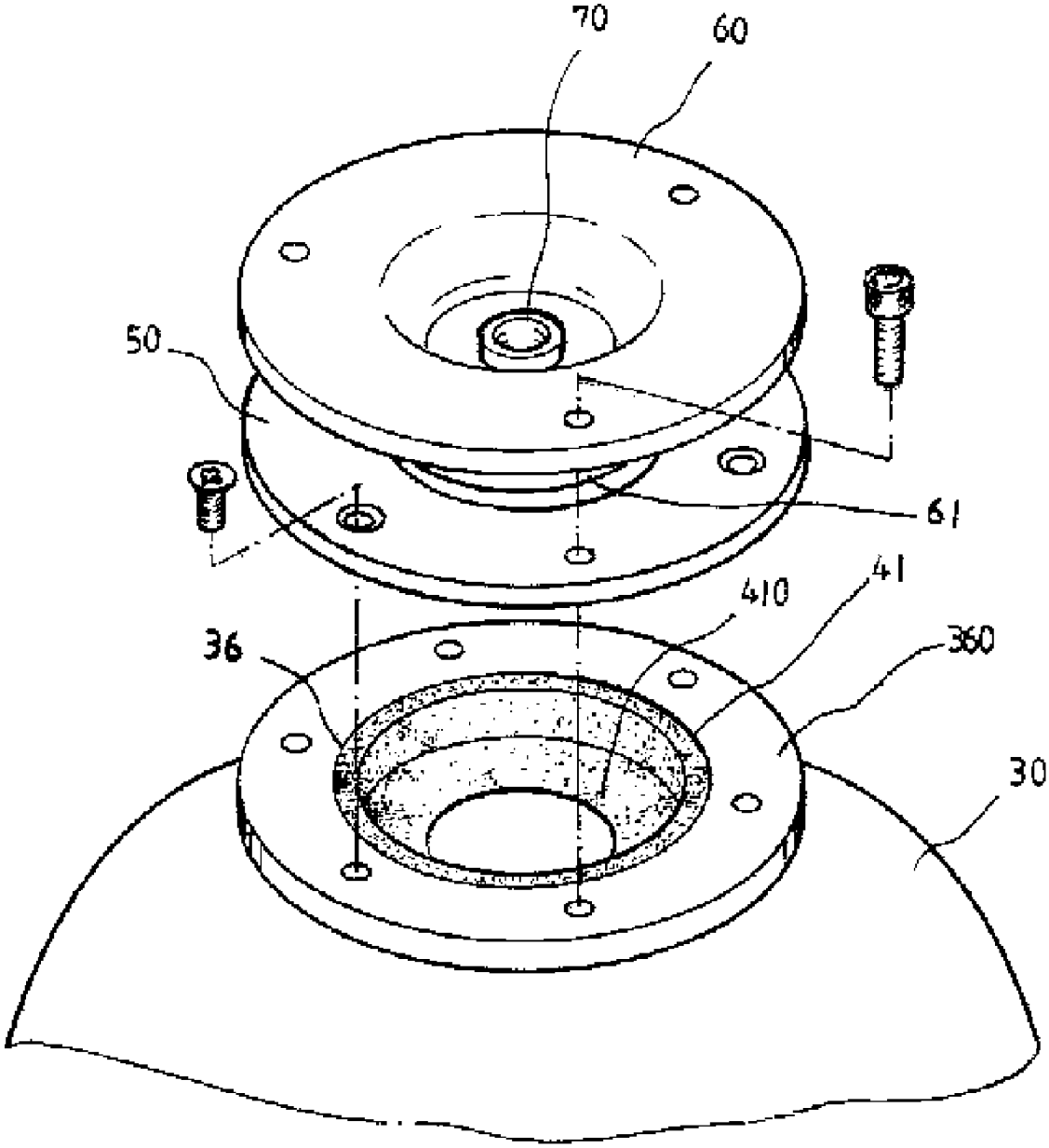
FIG. 5 is an exploded view of a top opening of the container shown in FIG. 3.
Figure 6:
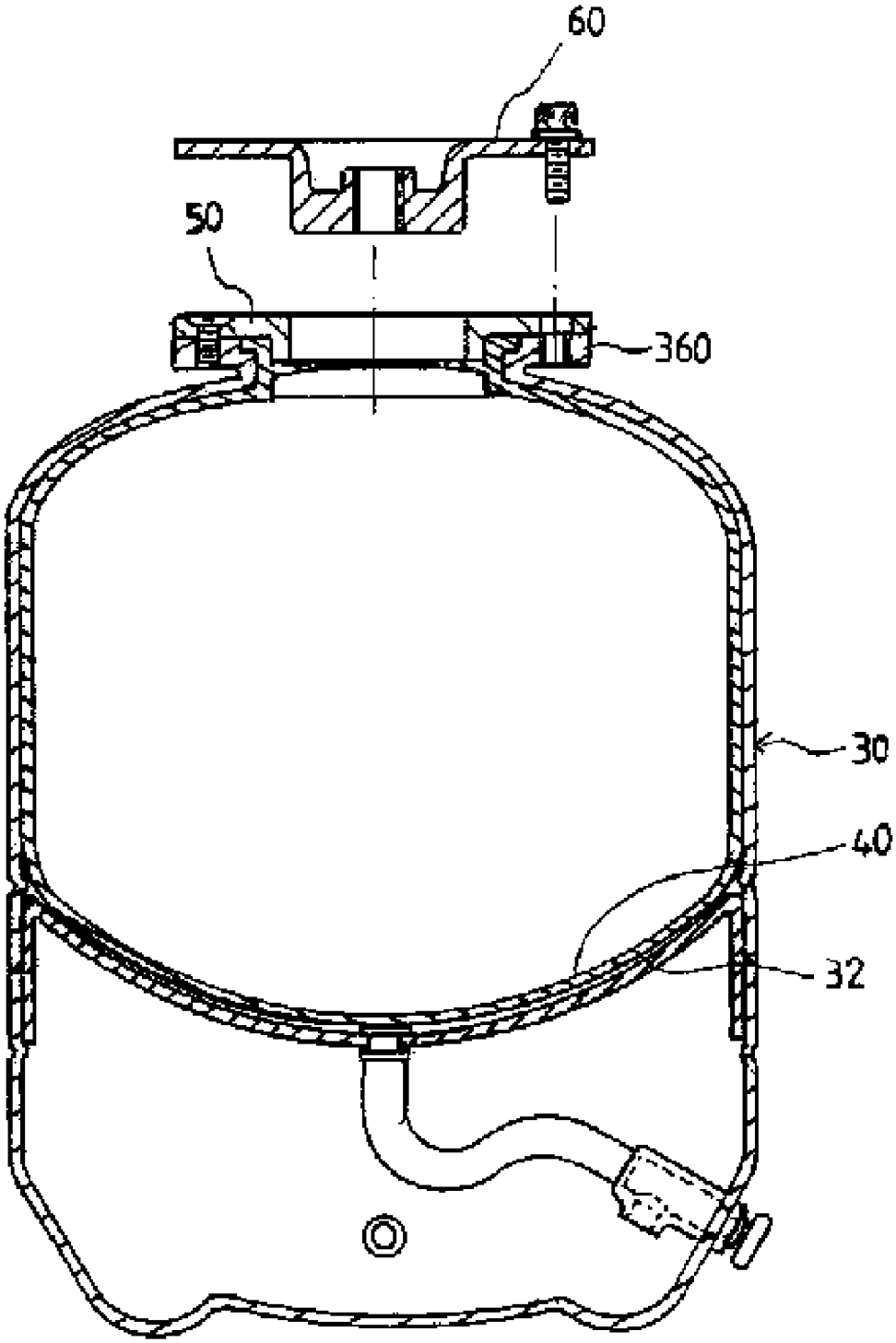
FIG. 6 is a view similar to FIG. 4 where a cap is moved out of a washer at the opening.
Figure 7:
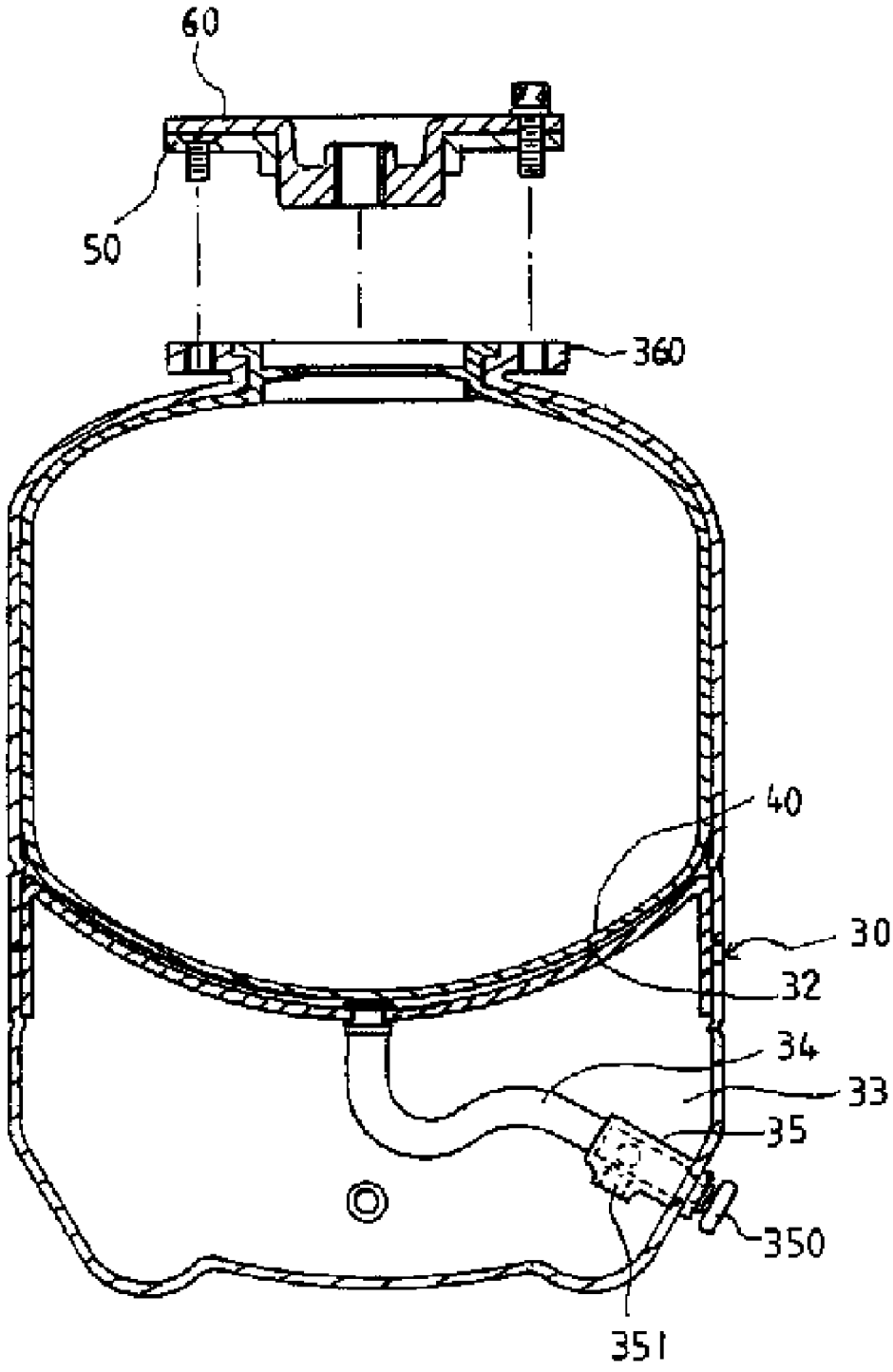
FIG. 7 is a view similar to FIG. 6 where the cap and the washer together moved out of the opening.

To the contrary, as shown in FIG. 4, a water storage operation is detailed below. After closing the port 351 by turning the hand wheel 350 in an opposite direction, clean water is fed into the water chamber 40 through the hole 70. Water contained in the water chamber 40 thus pushes down the lower surface thereof. As a result, air in the air chamber 32 is compressed to a minimum.

Moreover, a person may detach both the cap 60 and the washer 50 prior to replacing the water chamber 40 with a new one if such need arises. Advantageously, air pressure in the pressure chamber 33 substantially remains the same during the water chamber replacement. Further, maintenance and cleaning are facilitated by such configuration.

While the invention herein disclosed has been described by means of specific embodiments, numerous modifications and variations could be made thereto by those skilled in the art without departing from the scope and spirit of the invention set forth in the claims.

What is claimed is:

1. A pressurized water container for use with a drinking water purification system, comprising:

a housing comprising an opening, a rim at the opening, and first and second valves;

a sealing assembly releasably mounted on the opening of the housing;

a flexible water chamber in the housing, the water chamber comprising an opening in communication with the opening of the housing and a flexible sealing member mounted around the opening thereof;

a pressure chamber having a rigid surface fixedly secured to an inner surface of the housing wherein pressurized air is adapted to feed into the pressure chamber through the second valve for storage;

an air chamber between the water chamber and the pressure chamber; and a tube interconnecting the first valve and the air chamber, the tube having a port in communication with the pressure chamber, and a hand wheel disposed externally of the housing for either opening or closing the port;

wherein in response to opening the opening of the housing and the port, the pressurized air in the pressure chamber is adapted to flow into the air chamber through the tube to expand the air chamber and compress the water chamber for discharging water through the opening of the housing;

wherein in response to opening the opening of the housing and closing the port, water is adapted to feed into the water chamber through the opening of the housing to store by pushing the water chamber and compressing the air chamber;

wherein the sealing assembly comprises a ring-shaped washer threadedly secured onto the rim, and a cap threadedly secured onto both the washer and the rim to sealingly engage with the sealing member, the cap including a central opening in a central portion of the washer to communicate with the opening of the water chamber; and, wherein in response to detaching both the cap and the washer, a replacement of the water chamber is carried out.

* * * * *